US008612217B2

(12) United States Patent
Zhang et al.

(10) Patent No.: US 8,612,217 B2
(45) Date of Patent: Dec. 17, 2013

(54) METHOD AND SYSTEM FOR NOISE REDUCTION

(75) Inventors: Chen Zhang, Beijing (CN); Yuhong Feng, Beijing (CN)

(73) Assignee: Vimicro Corporation, Beijing (CN)

( * ) Notice: Subject to any disclaimer, the term of this patent is extended or adjusted under 35 U.S.C. 154(b) by 937 days.

(21) Appl. No.: 12/729,379

(22) Filed: Mar. 23, 2010

(65) Prior Publication Data

US 2010/0241426 A1 Sep. 23, 2010

(30) Foreign Application Priority Data

Mar. 23, 2009 (CN) ..... 2009 1 0080816

(51) Int. Cl.
*G10L 21/02* (2013.01)

(52) U.S. Cl.
USPC ..... 704/226; 704/227

(58) Field of Classification Search
USPC ..... 704/226–228
See application file for complete search history.

(56) References Cited

U.S. PATENT DOCUMENTS 5,828,997 A * 10/1998 Durlach et al. ..... 704/233
7,415,117 B2 * 8/2008 Tashev et al. ..... 381/92
7,925,504 B2 * 4/2011 Tsujikawa ..... 704/233
8,005,238 B2 * 8/2011 Tashev et al. ..... 381/94.2
2005/0094795 A1 * 5/2005 Rambo ..... 379/202.01
2005/0195988 A1 * 9/2005 Tashev et al. ..... 381/92
2005/0265562 A1 * 12/2005 Rui ..... 381/92
2008/0130914 A1 * 6/2008 Cho ..... 381/94.1
2008/0154592 A1 * 6/2008 Tsujikawa ..... 704/233
2008/0267422 A1 * 10/2008 Cox ..... 381/92
2008/0310646 A1 * 12/2008 Amada ..... 381/73.1
2010/0265799 A1 * 10/2010 Cevher et al. ..... 367/121

* cited by examiner

*Primary Examiner* — Douglas Godbold

(74) *Attorney, Agent, or Firm* — Duane Morris LLP; David T. Xue

(57) ABSTRACT

Techniques pertaining to noise reduction are disclosed. According to one aspect of the present invention, noise in an audio signal is effectively reduced and a high quality of a target voice is recovered at the same time. In one embodiment, an array of microphones is used to sample the audio signal embedded with noise. The samples are processed according to a beamforming technique to get a signal with an enhanced target voice. A target voice is located in the audio signal sampled by the microphone array. A credibility of the target voice is determined when the target voice is located. The voice presence probability is weighted by the credibility. The signal with the enhanced target voice is enhanced according to the weighed voice presence probability.

10 Claims, 5 Drawing Sheets

METHOD AND SYSTEM FOR NOISE REDUCTION

BACKGROUND OF THE INVENTION

1. Field of the Invention

The present invention relates to audio signal processing, more particularly to a method and a system for noise reduction.

2. Description of Related Art

In general, there are two methods to reduce noise in audio signal. One is noise reduction by a single microphone, and the other is noise reduction by a microphone array. The conventional methods for noise reduction however are not sufficient in some applications. Thus, improved techniques for noise reduction are desired.

SUMMARY OF THE INVENTION

This section is for the purpose of summarizing some aspects of the present invention and to briefly introduce some preferred embodiments. Simplifications or omissions in this section as well as in the abstract or the title of this description may be made to avoid obscuring the purpose of this section, the abstract and the title. Such simplifications or omissions are not intended to limit the scope of the present invention.

In general, the present invention is related to noise reduction. According to one aspect of the present invention, noise in an audio signal is effectively reduced and a high quality of a target voice is recovered at the same time. In one embodiment, an array of microphones is used to sample the audio signal embedded with noise. The samples are processed according to a beamforming technique to get a signal with an enhanced target voice. A target voice is located in the audio signal sampled by the microphone array. A credibility of the target voice is determined when the target voice is located. The voice presence probability is weighted by the credibility. The signal with the enhanced target voice is enhanced according to the weighed voice presence probability.

The objects, features, and advantages of the present invention will become apparent upon examining the following detailed description of an embodiment thereof, taken in conjunction with the attached drawings.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

The detailed description of the present invention is presented largely in terms of procedures, steps, logic blocks, processing, or other symbolic representations that directly or indirectly resemble the operations of devices or systems contemplated in the present invention. These descriptions and representations are typically used by those skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams or the use of sequence numbers representing one or more embodiments of the invention do not inherently indicate any particular order nor imply any limitations in the invention.

Embodiments of the present invention are discussed herein with reference to FIGS. 1-8. However, those skilled in the art will readily appreciate that the detailed description given herein with respect to these figures is for explanatory purposes only as the invention extends beyond these limited embodiments.

One of the objectives, advantages and benefits of the present invention is to provide improved techniques to reduce noise effectively and ensure a high quality of a target voice at the same time. In the following description, a microphone array including a pair of microphones MIC1 and MIC2 is used as an example to describe various implementation of the present invention. Those skilled in the art shall appreciate that the microphone array may include a plurality of microphones and shall be equally applied herein.

Figure 1:
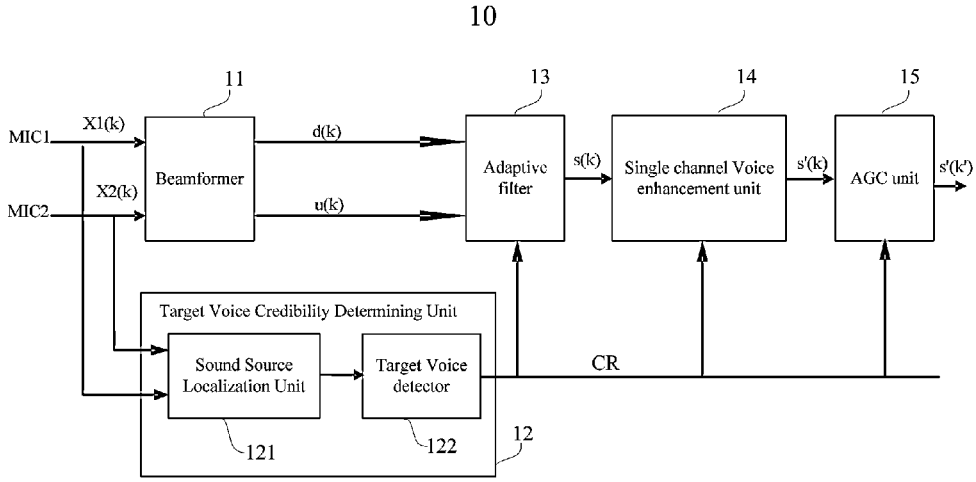
FIG. 1 is a block diagram showing a system for noise reduction according to one embodiment of the present invention.

FIG. 1 is a block diagram showing a system 10 for noise reduction according to one embodiment of the present invention. A pair of microphones MIC1 and MIC2 forms the microphone array. The microphone MIC1 samples an audio signal X1($k$), and the microphone MIC2 samples an audio signal X2($k$). The audio signal X1($k$) and X2($k$) are processed according to a beamforming algorithm to generate two output signals separated in space. The system 10 comprises a beamformer 11, a target voice credibility determining unit 12, an adaptive filter 13, a single channel voice enhancement unit 14 and an auto gain control (AGC) unit 15. The adaptive filter 13 and the auto gain control (AGC) unit 15 are provided to get better noise reduction effect, and may not be necessary for the system 10 in some embodiments.

The microphone MIC1 samples an audio signal X1($k$), and the microphone MIC2 samples an audio signal X2($k$). The beamformer 11 is configured to process the audio signals X1($k$) and X2($k$) sampled by the microphones MIC1 and MIC2 according to a beamforming algorithm and generate two output signals separated in space. One output signal is a signal with enhanced target voice d(k) that mainly comprises target voice, and the other output signal is a signal with weakened target voice u(k) that mainly comprises noise.

The beamforming algorithm processes the audio signals sampled by the microphone array. According to one arrangement, the microphone array has a larger gain in a certain direction in space domain and has a smaller gain in other directions in space domain, thus forming a directional beam. The formed directional beam is directed to a target sound source which generates the target voice in order to enhance the target voice because a target sound source is separated from a noise source generating the noise in space.

Figure 2:
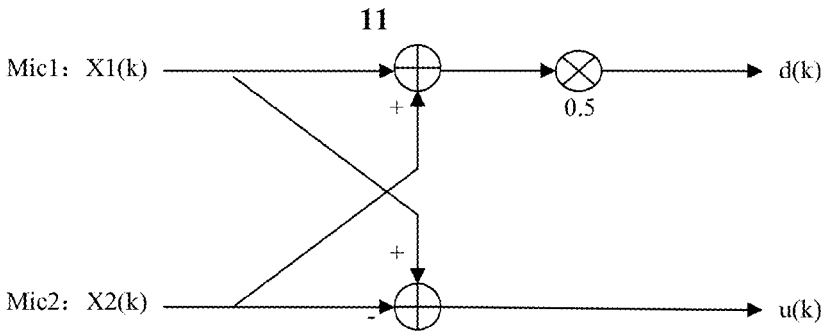
FIG. 2 is a schematic diagram showing an exemplary beamformer according to one embodiment of the present invention.

For the two microphones arranged in broadside manner, the target voices sampled by the two microphones have substantially same phase and amplitude because the target sound source locates equidistant from the two microphones. Hence, adding the audio signal X1(*k*) to the audio signal X2(*k*) may help to enhance the target voice, and subtracting the audio signal X2(*k*) from the audio signal X1(*k*) may help to weaken the target voice. FIG. 2 shows an exemplary beamformer 11 according to one embodiment of the present invention, where d(k) is a signal with enhanced target voice, and u(k) is the signal with weaken target voice:

$$d(k)=(X1(k)+X2(k))/2 \quad [1]$$

$$u(k)=X1(k)-X2(k) \quad [2]$$

The target voice credibility determining unit 12 is configured to determine a credibility of the target voice when the target voice is located by analyzing the audio signals sampled by the microphone array. In one embodiment, the target voice credibility determining unit 12 further comprises a sound source localization unit 121 and a target voice detector 122.

The sound source localization unit 121 is configured to compute a Maximum Cross-Correlation (MCC) value of the audio signals sampled by the microphone array, determine a time difference that the target voice arrives at the different microphones based on the MCC value, and determine an incidence angle of the target voice relative to the microphone array based on the time difference. The target voice detector 122 is configured to determine a credibility of the target voice by comparing the incidence angle of the target voice with a preset incidence angle range.

The sound source localization unit 121 is described with reference to FIG. 1. The audio signals sampled by different microphones may have phase difference because the times when the target voice arrives at the different microphones are different. The phase difference can be estimated by analyzing the audio signals sampled by the microphone array. Then, an incidence angle of the target voice relative to the microphone array can be estimated according to the structure and size of the microphone array and the estimated phase difference.

Figure 3:
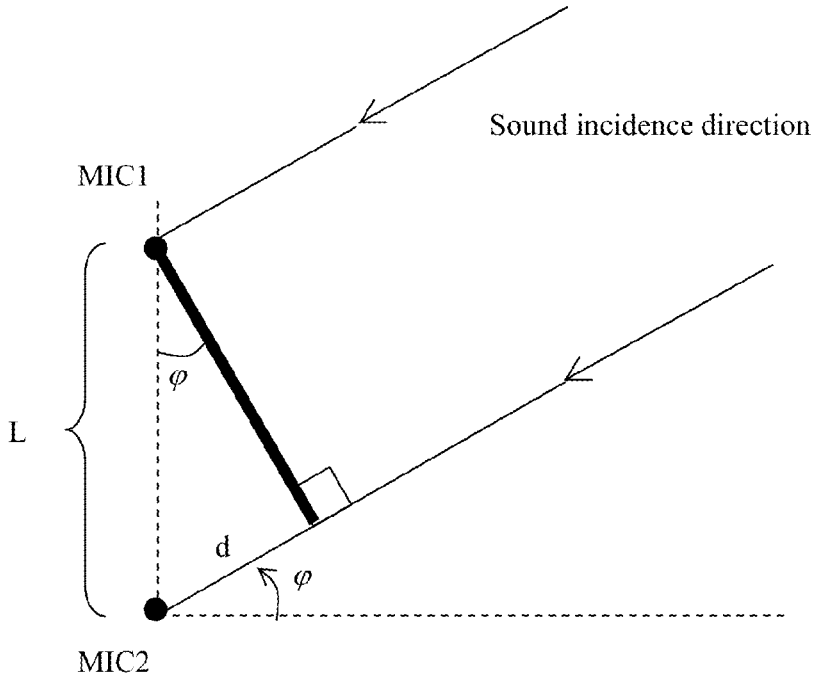
FIG. 3 is a schematic diagram showing an operation principle of a sound source localization unit according to one embodiment of the present invention.
Figure 4:
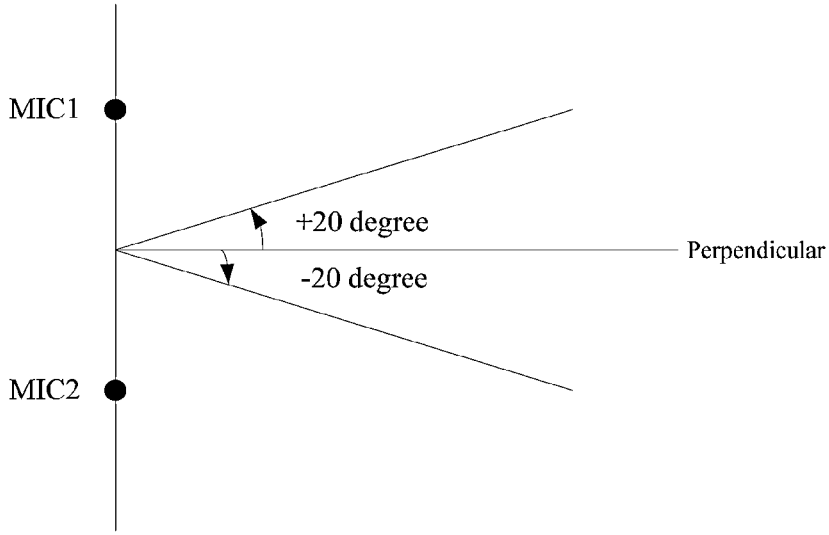
FIG. 4 is a schematic diagram showing a preset incidence angle range of a target voice according to one embodiment of the present invention.

FIG. 3 is a schematic diagram showing the operation of the sound source localization unit 121 according to one embodiment of the present invention. Referring to FIG. 4, there is a relationship:

$$d=L\sin(\phi)/c \quad [3]$$

where d is a time difference (also referred as a distance difference) that the target voice arrives at the two microphones MIC1 and MIC2, c is a sound velocity, L is a distance between the two microphones MIC1 and MIC2, ϕ is the incidence angle of the target voice relative to the microphone array. Transforming the equation (3), it gets:

$$\phi=\arcsin(cd/L) \quad [4]$$

It can be seen that the incidence angle ϕ may be calculated if the time difference d that the target voice arrives at the two microphones MIC1 and MIC2 is estimated accurately.

The time difference d can be estimated according to:

$$d=\underset{\tau}{\operatorname{argmax}}(R_{x_1x_2}(\tau)) \quad [5]$$

where X1, X2 denote respectively the audio signals sampled by the microphones MIC1 and MIC2, $R_{x_1x_2}(\tau)$ is a cross-correlation function of the two audio signals X1, X2, τ is the phase difference of the two audio signals X1, X2, and max ($R_{x1x2}(\tau)$) is the MCC value.

The cross-correlation function $R_{x_1x_2}(\tau)$ is:

$$R_{x_1x_2}(\tau)=\sum_{k=0}^{N-1}X_1(k)X_2(k-\tau) \quad [6]$$

wherein N is a length of one frame of audio signal X1 or X2, k denotes sample points of one frame of audio signal X1 or X2.

Transforming the equation (6) from time domain to frequency domain because τ is not an integer in many cases, it gets:

$$R_{x_1x_2}(\tau)=\sum_{k=0}^{N-1}X_1(k)X_2(k)^*e^{j2\pi k\tau/N} \quad [7]$$

In one embodiment, the sound source localization unit 121 may obtain multiple cross-correlation values corresponding to multiple phase differences τ, determine multiple incidence angles corresponding to the multiple cross-correlation values, select one or more incidence angles which have maximum cross-correlation values, and output the selected incidence angles. For example, three incidence angles ϕ1, ϕ2, ϕ3 are selected and outputted to the target voice detector 122 in order, wherein the cross-correlation value corresponding to the incidence angle ϕ1 is maximum, the cross-correlation value corresponding to the incidence angle ϕ2 is medium relatively, and the cross-correlation value corresponding to the incidence angle ϕ3 is minimum relatively.

Referring again to FIG. 3, it can be seen that a possible range of the incidence angle is from −90 degree to +90 degree. Only one side of the microphone array is considered because the left side and the right side of the microphone array are symmetrical. If the target voice is directed perpendicular to the microphone array, the incidence angle would be 0 degree.

The target voice detector 122 is configured to preset an incidence angle range, assign a different credibility to each of the different incidence angles of the target voice according to corresponding cross-correlation values, determine whether the incidence angles of the target voice belong to the preset incidence angle range, and select the larger credibility of the incidence angles which belong to the preset incidence angle range or a minimum credibility (e.g. 0) if none of the incidence angles belong to the preset incidence angle range as a final credibility of the target voice. The larger the cross-correlation value of the incidence angle is, the higher the credibility assigned to the incidence angle is.

Figure 5:
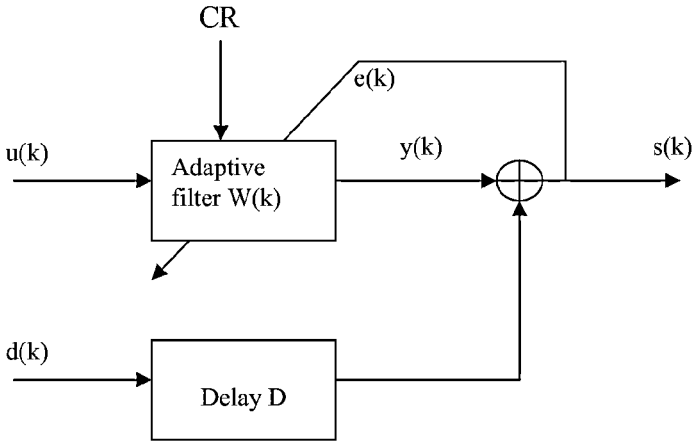
FIG. 5 is a schematic diagram showing an exemplary adaptive filter according to one embodiment of the present invention.

For example, it is assumed that the preset incidence angle range is from −20 degree to +20 degree as shown in FIG. 5, ϕ1=40 degree, ϕ2=10 degree and ϕ3=5 degree. The credibility of the incidence angle ϕ1 with maximum cross-correlation value is assigned as 100%, the credibility of the incidence angle $\phi 2$ with medium cross-correlation value is assigned as 80%, and the credibility of the incidence angle $\phi 3$ with minimum cross-correlation value is assigned as 60%. It can be seen that the incidence angles $\phi 2$ and $\phi 3$ belong to the preset incidence angle range, so the larger credibility 80% is selected as the final credibility of the target voice. For another example, the minimum credibility (e.g. 0) is selected as the final credibility of the target voice if none of the incidence angles $\phi 1$, $\phi 2$, and $\phi 3$ belong to the preset incidence angle range. The final credibility of the target voice is denoted by CR hereafter. The target voice detector 122 outputs the final credibility CR of the target voice to the adaptive filter 13, the single channel voice enhancement unit 14, and the AGC unit 15.

FIG. 5 is a schematic diagram showing an exemplary adaptive filter 13 according to one embodiment of the present invention. The signal with enhanced target voice d(k) output from the beamformer 11 is used as a main input signal of the adaptive filter 13, and the signal with weaken target voice u(k) output from the beamformer 11 is used as a reference input signal of the adaptive filter 13 to simulate a noise component in the signal d(k). The adaptive filter 13 is configured for updating an adaptive filter coefficient according to the credibility CR of the target voice, and filtering the signal d(k) and the signal u(k) according to the adaptive filter coefficient. In one embodiment, an update step size $\mu$ of the adaptive filter coefficient is determined according to the credibility CR of the target voice, e.g. $\mu=1-CR$.

The adaptive filter 13 filters the noise component simulated by the reference input signal u(k) from the main input signal d(k) to get the signal with reduced noise s(k). The precondition that the adaptive filter 13 works normally is that the signal u(k) mainly comprises a noise component, otherwise, the adaptive filter 13 may result in distortion of the target voice. In the present embodiment, the credibility CR is provided to control the update of adaptive filter coefficient, thereby the adaptive filter coefficient is updated only when the signal u(k) comprises mainly the noise component.

If the credibility CR is very high, the update step size may be small, so the adaptive filter 13 may not update the adaptive filter coefficient. At this time, the adaptive filter 13 filters the signal d(k) and the signal u(k) according to the original adaptive filter coefficient and outputs $e(k)=d(k)-y(k)$. If the credibility CR is very small, the update step size may be large, so the adaptive filter 13 may update the adaptive filter coefficient. At this time, the adaptive filter 13 filters the signal d(k) and the signal u(k) according to the updated adaptive filter coefficient and outputs $e(k)=d(k)-y(k)$.

Next, an exemplary operation principle of the adaptive filter 13 is described in detail hereafter. Provided that an order of the adaptive filter 13 is M, and the filter coefficient is denoted as w(k). In order to avoid aliasing, the M-order adaptive filter 13 is expanded by M zero to get 2M filter coefficients.

Accordingly, a coefficient vector W(k) of the adaptive filter 13 in frequency domain is:

$$W(k) = FFT\begin{bmatrix} w(k) \\ 0 \end{bmatrix} \quad [8]$$

A last frame and a current frame of the reference input signal u(k) are combined into one expansion frame $\bar{u}(k)$ according to:

$$\bar{u}(k)=u(kM-M), \ldots, u(kM-1), u(kM), \ldots, u(kM+M-1) \quad [9]$$

where $u(kM-M), \ldots, u(kM-1)$ is the last frame $k-1$, and $u(kM), \ldots, u(kM+M-1)$ is the current frame k. Then, the expansion frame $\bar{u}(k)$ is FFT transformed into frequency domain according to:

$$U(k)=FFT[\bar{u}(k)] \quad [10]$$

Subsequently, the reference input signal is filtered according to:

$$y(k)=[y(kM), y(kM+1), \ldots, y(kM+M-1)= IFFT[U(k)*W(k)] \quad [11]$$

wherein the first M points of the IFFT result is reserved for y(k).

The main input signal $\bar{d}(k)$ is:

$$\bar{d}(k)=[d(kM), d(kM+1), \ldots, d(kM+M-1)] \quad [12]$$

Then, an error signal $\bar{e}(k)$ is:

$$\begin{aligned} \bar{e}(k) &= [e(kM), e(kM+1), \ldots, e(kM+M-1)] \\ &= \bar{d}(k) - \bar{y}(k) \end{aligned} \quad [13]$$

After FFT, a vector of the error signal E(k) in frequency domain is:

$$E(k) = FFT\begin{bmatrix} 0 \\ \bar{e}(k) \end{bmatrix} \quad [14]$$

An update amount $\bar{\phi}(k)$ of the coefficient vector of the adaptive filter 13 is:

$$\bar{\phi}(k)=IFFFT[U^{H}(K)*E(K)] \quad [15]$$

where the first M points of the IFFT result is reserved for the update amount $\bar{\phi}(k)$.

Finally, the updated coefficient vector $W(k-1)$ of the adaptive filter 13 in frequency domain is:

$$W(k+1) = W(k) + \mu FFT\begin{bmatrix} \phi(k) \\ 0 \end{bmatrix} \quad [16]$$

wherein $\mu$ is the update step size, e.g. $\mu=1-CR$.

Experimental result shows that the adaptive filter 13 will work properly, and not converge wrongly when the microphone input is silent because an operation state of the adaptive filter 13 is controlled by the credibility CR outputted from the target voice detector 122. Finally, the adaptive filter 13 outputs the signal with reduced noise s(k) to the single channel voice enhancement 14 for further noise reduction.

In one embodiment, the signal with reduced noise s(k) is used as an input signal of the single channel voice enhancement unit 14. In other embodiment, the signal with enhanced target voice d(k) may be used as the input signal of the single channel voice enhancement unit 14 directly if the adaptive filter 13 is absent. The single channel voice enhancement unit 14 is configured for weighing a voice presence probability by the credibility CR, and enhancing the input signal thereof s(k) or d(k) according to the weighed voice presence probability.

The signal with reduced noise s(k) used as the input signal of the single channel voice enhancement unit 14 is taken as example for explanation hereafter. The single channel voice enhancement unit 14 comprises a weighing unit, a gain estimating unit and an enhancement unit. The weighing unit is provided to weigh the voice presence probability by the credibility CR. The gain estimating unit is provided to estimate a gain of each frequency band of the input signal s(k) according to a noise variance, a voice variance, a gain during voice absence and the weighed voice presence probability. The enhancement unit is provided to enhance the input signal s(k) according to the estimated gain of each frequency band to further reduce the noise from the input signal s(k).

In one embodiment, the single channel voice enhancement unit 14 processes signal in frequency domain according to:

$$S'(k)=S(k)*G(k) \quad [17]$$

where S'(k) is the output signal of the enhancement unit 14 in frequency domain, S(k) is the input signal of the enhancement unit 14 in frequency domain, and G(k) is a gain of each frequency band in frequency domain.

The gain of each frequency band G(k) is:

$$G[k]=\left(\frac{\lambda_x[k]}{\lambda_x[k]+\lambda_d[k]}\right)^{\alpha}*p(H_l[k]\mid Y[L])+G_{min}*(1-p(H_1[k]\mid Y[L]) \quad [18]$$

where $\lambda_x[k]$ is the estimated noise variance, $\lambda_d[k]$ is the estimated voice variance, $p(H_1[k]|Y[L]$ is the voice presence probability, $G_{min}$ is the gain during voice absence, and $\alpha$ is a constant of which the range is [0.5,1].

In one embodiment, the voice presence probability $p(H_1[k]|Y[L]$ is weighed by the credibility CR according to:

$$p'(H_1[k]|Y[k])=p(H_1[k]|Y[k])CR \quad [19]$$

where $p'(H_1[k]|Y[L]$ is the weighed voice presence probability. Substituting $p'(H_1[k]|Y[L]$ for $p(H_1[k]|Y[L]$ in the equation (18), the gain of each frequency band G(k) is modified as:

$$G[k]=\left(\frac{\lambda_{x[k]}}{\lambda_x[k]+\lambda_d[k]}\right)^{\alpha}*p'(H_1[k]\mid Y[L])+G_{min}*(1-p'(H_1[k]\mid Y[L]) \quad [20]$$

Figure 6:
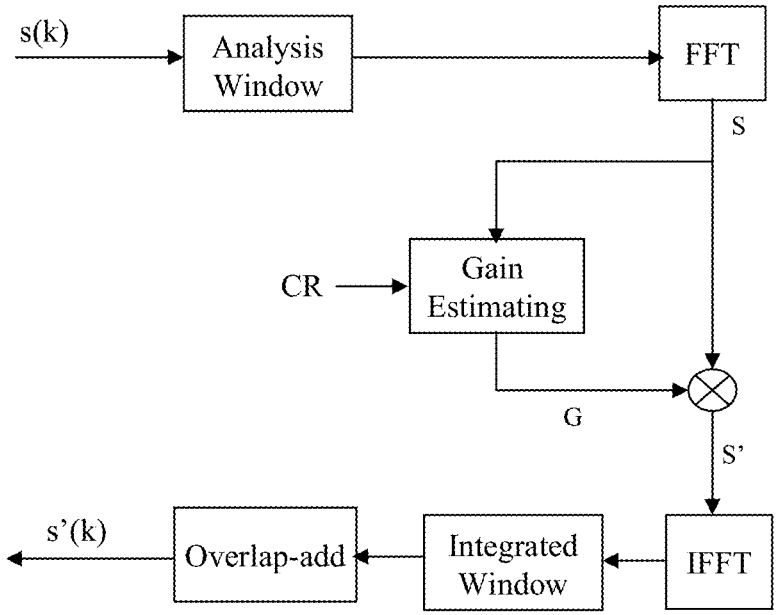
FIG. 6 is a schematic diagram showing an exemplary single channel voice enhancement unit according to one embodiment of the present invention.

FIG. 6 is a schematic diagram showing an exemplary single channel voice enhancement unit 14 according to one embodiment of the present invention. The input signal s(k) is processed by an analysis window. Specifically, a last frame and a current frame of the input signal s(k) are combined into one expansion frame, and then the expansion frame is weighed by a sine window function. After the analysis window process, the signal s(k) is FFT transformed into frequency domain to get S(k).

At the same time, the gain G(k) is estimated according to the equation [20]. Subsequently, the signal S(k) is multiplied by the gain G(k) according to the equation [17] to get the signal S'(k). Then, the signal S'(k) is IFFT transformed into the signal s'(k). The signal s'(k) is processed by an integrated window, where a sine window function is selected.

Finally, the first half result of the signal s'(k) after integrated window process is overlap-added to a reserved result of the last frame, and the sum is used as a reserved result of the current frame and outputted as a final result at the same time.

As described above, the single channel voice enhancement unit 14 further reduces noise from the signal s(k) and outputs the target voice signal s'(k) to the AGC unit 15. The AGC unit 15 is provided to automatically control a gain of the target voice signal s'(k) according to the credibility CR. The AGC unit 15 comprises an inter-frame smoothing unit and an intra-frame smoothing unit. The inter-frame smoothing unit is provided to determine a temporary gain of the target voice signal s'(k) according to the credibility CR, and inter-frame smooth the temporary gain of the target voice signal s'(k). The intra-frame smoothing is provided to intra-frame smooth the gain of the target voice signal outputted from the inter-frame smoothing unit.

The AGC unit 15 selects different gain according to different credibility CR to further restrict noise. In one embodiment, gain_tmp=max (CR,0.3), wherein gain_tmp is the temporary gain of the current frame of the target voice signal s'(k). For example, if CR=1, that indicates that the credibility is very high, so gain_tmp=1, the temporary gain is assigned with a higher gain value; if CR=0, that indicates that the credibility is very low, so gain_temp=0.3, the temporary gain is assigned with a lower gain value.

In order to avoid the amplitude jump of the output signal, the inter-frame smoothing unit is provided to inter-frame smooth the temporary gain gain_tmp according to:

$$\text{gain}=\text{gain}*\alpha+\text{gain_}tmp(1-\alpha) \quad [21]$$

where $\alpha$ is a smoothing factor.

In general, if the change of the gain is finished in 50 ms according to AGC principle, the amplitude change of the output signal may not bring into noise. Provided that the sample frequency is 8 k, 0.05*8 k=400 points are sampled in 50 ms, and one frame signal comprises 128 sample points, then the minimum value of the smoothing factor $\alpha$ is 0.75.

Additionally, the quality of the target voice is of primary consideration, so a project of rapid-up and slow-down is used. In other words, if the credibility CR equals to 1, the gain is increased quickly; if the credibility CR equals to 0, the gain is decreased slowly. For example, if CR=1, then $\alpha$=0.75; if CR=0, then $\alpha$=0.95.

Figure 7:
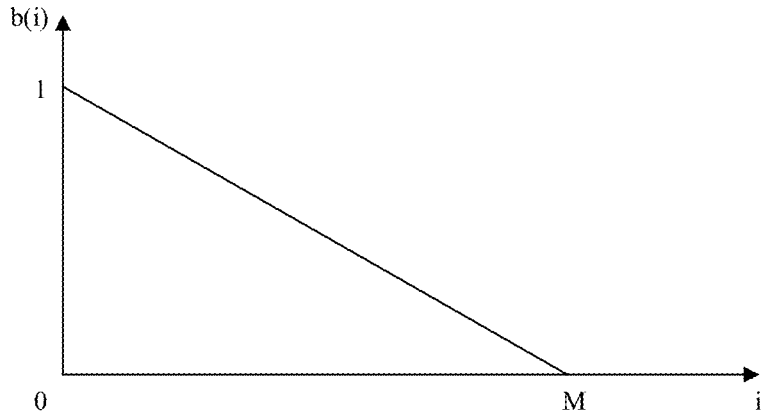
FIG. 7 is a schematic diagram showing a ramp function b(i) according to one embodiment of the present invention.

In order to further avoid the amplitude jump of the output signal, the intra-frame smoothing unit is provided to intra-frame smooth the gain of the target voice signal according to:

$$\text{gain}'(i)=b(i)\text{gain_old}+(1-b(i))\text{gain_new}\quad i=0\sim M-1 \quad [22]$$

where b(i) is a ramp function as shown in FIG. 7, b(i)=1−i/M, gain_old is the gain of the last frame after the inter-frame smoothing, gain_new is the gain of the current frame after the intra-frame smoothing, gain'(i) is the gain of the ith point of the current frame, and M=128.

Finally, the output signal s'(k) of the single channel voice enhancement unit 14 is adjusted by the gain gain'(k) after the inter-frame smoothing and the intra-frame smoothing according to:

$$s''(k)=s'(k)*\text{gain}'(k) \quad [23]$$

where s''(k) is the output signal of the AGC unit 15.

Figure 8:
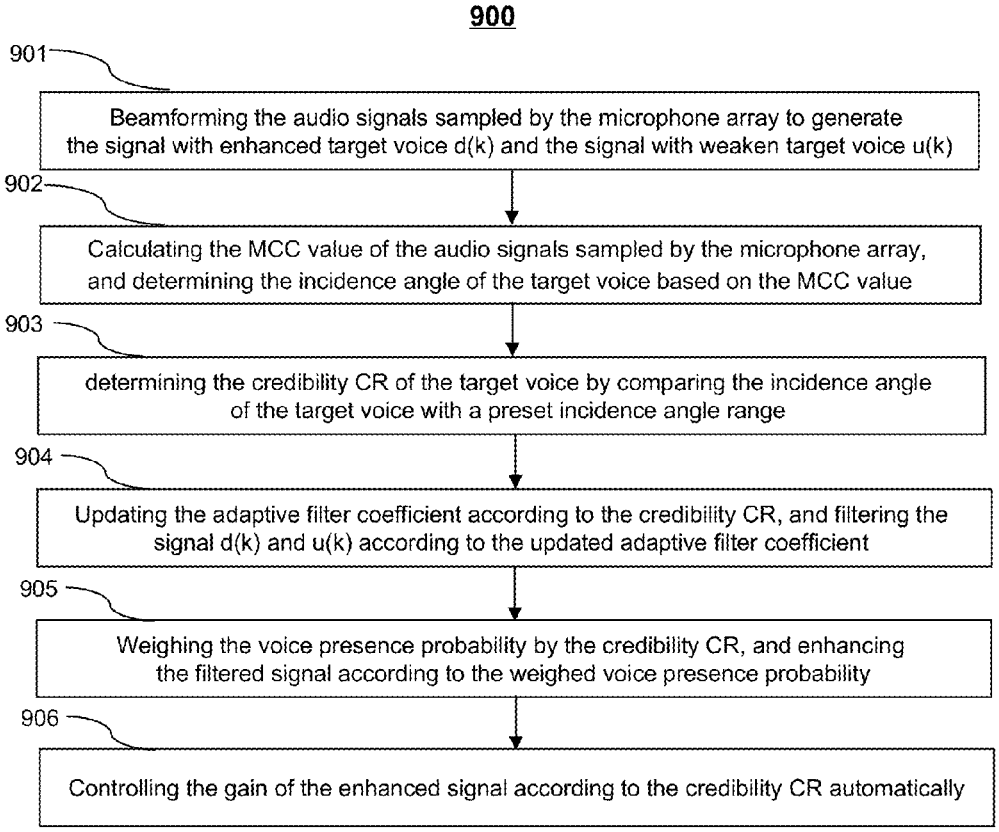
FIG. 8 is a schematic flow chart showing a method for noise reduction according to one embodiment of the present invention.

FIG. 8 is a schematic flow chart showing a method 900 for noise reduction according to one embodiment of the present invention. The method 900 comprises the following operations.

At 901, the audio signals X1(*k*) and X2(*k*) sampled by the microphone array are processed according to the beamforming algorithm to generate the signal with enhanced target voice d(k) and the signal with weakened target voice u(k).

At 902, the maximum cross-correlation value of the audio signals X1(*k*) and X2(*k*) sampled by the microphone array are calculated, and the incidence angle of the target voice relative to the microphone array is determined based on the maximum cross-correlation value. Specifically, compute the maximum cross-correlation value of the audio signals sampled by the microphone array is computed, the time difference that the target voice arrives at the different microphones is determined based on the maximum cross-correlation value, and the incidence angle of the target voice relative to the microphone array is determined based on the time difference.

At 903, the credibility of the target voice is determined by comparing the incidence angle of the target voice with a preset incidence angle range.

At 904, the update of the adaptive filter coefficient is controlled by the credibility of the target voice, and the signal d(k) and u(k) are filtered according to the updated adaptive filter coefficient to get the signal with reduced noise s(k).

At 905, the voice presence probability is weigh by the credibility CR, and the signal with reduced noise s(k) is single channel voice enhanced according to the weighed voice presence probability.

At 906, the gain of the signal s'(k) after single channel voice enhancement is automatically controlled according to the credibility CR.

The present invention has been described in sufficient details with a certain degree of particularity. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the foregoing description of embodiments.

What is claimed is:

1. A method for noise reduction, comprising:

beamforming audio signals sampled by a microphone array to get a signal with an enhanced target voice;

locating a target voice in the audio signal sampled by the microphone array;

determining a credibility of the target voice when the target voice is located;

weighing a voice presence probability by the credibility; and enhancing the signal with the enhanced target voice according to the weighed voice presence probability;

wherein said locating a target voice in the audio signal sampled by the microphone array comprises:

computing cross-correlation values of the audio signals sampled by the microphone array; selecting multiple cross-correlation values which are maximum relatively;

determining a time difference that the target voice arrives at different microphones of the microphone array corresponding to each cross-correlation value; and determining an incidence angle of the target voice relative to the microphone array based on each time difference.

2. The method according to claim 1, wherein said locating a target voice in the audio signal sampled by the microphone array comprises:

computing a maximum cross-correlation value of the audio signals sampled by the microphone array;

determining a time difference that the target voice arrives at different microphones of the microphone array based on the maximum cross-correlation value; and determining an incidence angle of the target voice relative to the microphone array based on the time difference.

3. The method according to claim 2, wherein the determining a credibility of the target voice when the target voice is located comprises:

determining the credibility of the target voice by comparing the incidence angle of the target voice with a preset incidence angle range.

4. The method according to claim 1, wherein the determining a credibility of the target voice when the target voice is located comprises:

assigning different credibility to different incidence angles of the target voice, wherein the larger the cross-correlation value of the incidence angle is, the higher the credibility assigned to the incidence angle is;

determining whether the incidence angles of the target voice belong to a preset incidence angle range; and selecting a larger credibility of the incidence angles which belong to the preset incidence angle range or minimum credibility if none of the incidence angles belong to the preset incidence angle range as a final credibility of the target voice.

5. The method according to claim 1, wherein said enhancing the signal with enhanced target voice comprises:

estimating a gain of each frequency band of the signal with enhanced target voice according to a noise variance, a voice variance, a gain during voice absence and the weighed voice presence probability; and enhancing the signal with enhanced target voice according to the estimated gain of each frequency.

6. A system for noise reduction, comprising:

a beamformer configured for beamforming audio signals sampled by a microphone array to get a signal with an enhanced target voice;

a target voice credibility determining unit configured for locating a target voice in the audio signal sampled by the microphone array, and determining a credibility of the target voice when the target voice is located;

a single channel voice enhancement unit configured for weighing a voice presence probability by the credibility, and enhancing the signal with the enhanced target voice according to the weighed voice presence probability;

wherein the target voice credibility determining unit comprises a sound source localization unit and a target voice detector, the sound source localization unit is configured for computing cross-correlation values of the audio signals sampled by the microphone array, selecting multiple cross-correlation values which are maximum relatively, determining a time difference that the target voice arrives at different microphones of the microphone array corresponding to each cross-correlation value, and determining an incidence angle of the target voice relative to the microphone array based on each time difference;

the target voice detector is configured for assigning different credibility to different incidence angles of the target voice, determining whether the incidence angles of the target voice belong to a preset incidence angle range, and selecting a larger credibility of the incidence angles which belong to the preset incidence angle range or minimum credibility if none of the incidence angles belong to the preset incidence angle range as a final credibility of the target voice, wherein the larger the cross-correlation value of the incidence angle is, the higher the credibility assigned to the incidence angle is.

7. The system according to claim 6, wherein the target voice credibility determining unit comprises a sound source localization unit and a target voice detector, the sound source localization unit is configured for computing a maximum cross-correlation value of the audio signals sampled by the microphone array, determining a time difference that the target voice arrives at different microphones of the microphone array based on the maximum cross-correlation value, and determining an incidence angle of the target voice relative to the microphone array based on the time difference;

the target voice detector is configured for determining the credibility of the target voice by comparing the incidence angle of the target voice with a preset incidence angle range.

8. The system according to claim 6, wherein the single channel voice enhancement unit comprises a weighing unit, a gain estimating unit and an enhancement unit, the weighing unit is configured for weighing a voice presence probability by the credibility;

the gain estimating unit is configured for estimating a gain of each frequency band of the signal with enhanced target voice according to a noise variance, a voice variance, a gain during voice absence and the weighed voice presence probability; and the enhancement unit is configured for enhancing the signal with enhanced target voice according to the estimated gain of each frequency band.

9. The system according to claim 6, further comprising an adaptive filter, wherein the beamformer further gets a signal with weakened target voice, the adaptive filter is configured for updating an adaptive filter coefficient according to the credibility, and filtering the signal with enhanced target voice according to the updated adaptive filter coefficient to get a signal with reduced noise; and the single channel voice enhancement unit enhances the signal with reduced noise according to the weighed voice presence probability.

10. The system according to claim 6, further comprising an automatic gain control unit, wherein the automatic gain control unit is provided to control a gain of a signal outputted form the single channel voice enhancement unit according to the credibility automatically.

* * * * *